US010344964B2

(12) United States Patent
Yao

(10) Patent No.: US 10,344,964 B2
(45) Date of Patent: Jul. 9, 2019

(54) LIGHTING STRUCTURE FOR CEILING FAN

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 467 days.

(21) Appl. No.: 15/146,612

(22) Filed: May 4, 2016

(65) Prior Publication Data

US 2017/0321878 A1 Nov. 9, 2017

(51) Int. Cl.

| | |
|---|---|
| ***F21V 33/00*** | (2006.01) |
| ***F04D 25/08*** | (2006.01) |
| ***F21V 29/77*** | (2015.01) |
| *F21V 23/04* | (2006.01) |
| *F21V 23/00* | (2015.01) |
| *F21V 15/00* | (2015.01) |
| *F21Y 115/10* | (2016.01) |

(52) U.S. Cl.

CPC ..... *F21V 33/0096* (2013.01); *F04D 25/088* (2013.01); *F21V 29/77* (2015.01); *F21V 15/00* (2013.01); *F21V 23/001* (2013.01); *F21V 23/04* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 6,494,589 | B1 * | 12/2002 | Shyu | F21S 8/06 362/404 |
| 7,249,744 | B2 * | 7/2007 | Bacon | F04D 25/088 248/343 |
| 2006/0285310 | A1 * | 12/2006 | Shyu | F04D 25/088 362/96 |
| 2010/0282584 | A1 * | 11/2010 | Tseng | H01H 17/18 200/331 |
| 2015/0192136 | A1 * | 7/2015 | Yao | F04D 25/088 416/204 R |
| 2016/0108925 | A1 * | 4/2016 | Huang | F04D 29/4226 415/121.3 |
| 2016/0169503 | A1 * | 6/2016 | Chen | F21K 9/20 416/5 |

* cited by examiner

*Primary Examiner* — Elmito Breval

(74) *Attorney, Agent, or Firm* — C. G. Mersereau; DeWitt LLP

(57) ABSTRACT

A lighting structure for a ceiling fan includes a substrate. The substrate has a top surface and a bottom surface. At least a lamp is disposed on the bottom surface. A plurality of fins and an upright wall are disposed on the top surface. The upright wall extends upward and extends around an enclosure to form therein a receiving chamber for receiving a ceiling fan control device. A first connection portion is disposed near the top end of the upright wall and connected to the ceiling fan.

9 Claims, 5 Drawing Sheets

LIGHTING STRUCTURE FOR CEILING FAN

BACKGROUND OF THE INVENTION

1. Technical Field

The present invention relates to lighting structures and more particularly to a lighting structure for a ceiling fan.

2. Description of Related Art

Referring to FIG. 5, a conventional ceiling fan 5 essentially comprises a rotatable bladed fan 51, a driving device 52 for driving the bladed fan 51, and a control device 53 for controlling the driving device 52. The control device 53 has a box 531 which contains various electronic components 532 for controlling the driving device 52.

The ceiling fan 5 further comprises a lighting 54. The lighting 54 is coupled to the box 531 of the control device 53. The lighting 54 has a top surface 541. The box 531 has an opening 533 that faces downward. The box 531 is coupled to the top surface 541 through the opening 533 by a means of connection, such as a screw, to not only block the opening 533 but also couple the lighting 54 to the ceiling fan 5.

Since the top surface 541 functions as a cover for the box 531 to block the opening 533, the capacity of the box 531 depends on the walls of the box 531. To be cost-efficient or ergonomic, the box 531 is usually small, and various electronic components 532 and wires are contained in the box 531 crowdedly. After the ceiling fan 5 has been removed from the lighting 54 for the sake of maintenance, the electronic components 532 and wires could seldom be properly received in the box 531 again. If the electronic components 532 and wires are forcibly packed in the box 531, the electronic components 532 and wires will be damaged.

BRIEF SUMMARY OF THE INVENTION

It is an objective of the present invention to provide a lighting structure for a ceiling fan, characterized in that: an upright wall is disposed on the top surface of the substrate of the lighting structure and positioned beside fins disposed on the top surface of the substrate; the upright wall extends around to form a receiving chamber that properly receives parts, components and wires of a ceiling fan control device; and the parts, components and wires of the ceiling fan control device are conveniently connected by the upright wall and the ceiling fan.

In order to achieve the above and other objectives, the present invention provides a lighting structure for a ceiling fan, comprising:

a substrate having a top surface and a bottom surface;

at least a lamp disposed on the bottom surface of the substrate;

a plurality of fins disposed on the top surface of the substrate;

an upright wall disposed on the top surface of the substrate and extending upward, wherein the upright wall extends around an enclosure to form a receiving chamber within the enclosure, wherein a first connection portion is disposed near a top end of the upright wall and connected to the ceiling fan.

In an embodiment, the upright wall extends to form a circle, the fins are disposed outside the upright wall.

In an embodiment, a protective cover for covering the at least a lamp is disposed on the bottom surface of the substrate.

The ceiling fan comprises a support, a rotatable bladed fan, a driving device and a holder. The driving device is disposed on the support and connected to the bladed fan to drive the bladed fan to rotate. The holder is disposed on the support and connected to the first connection portion of the upright wall.

DETAILED DESCRIPTION OF THE INVENTION

Figure 1:
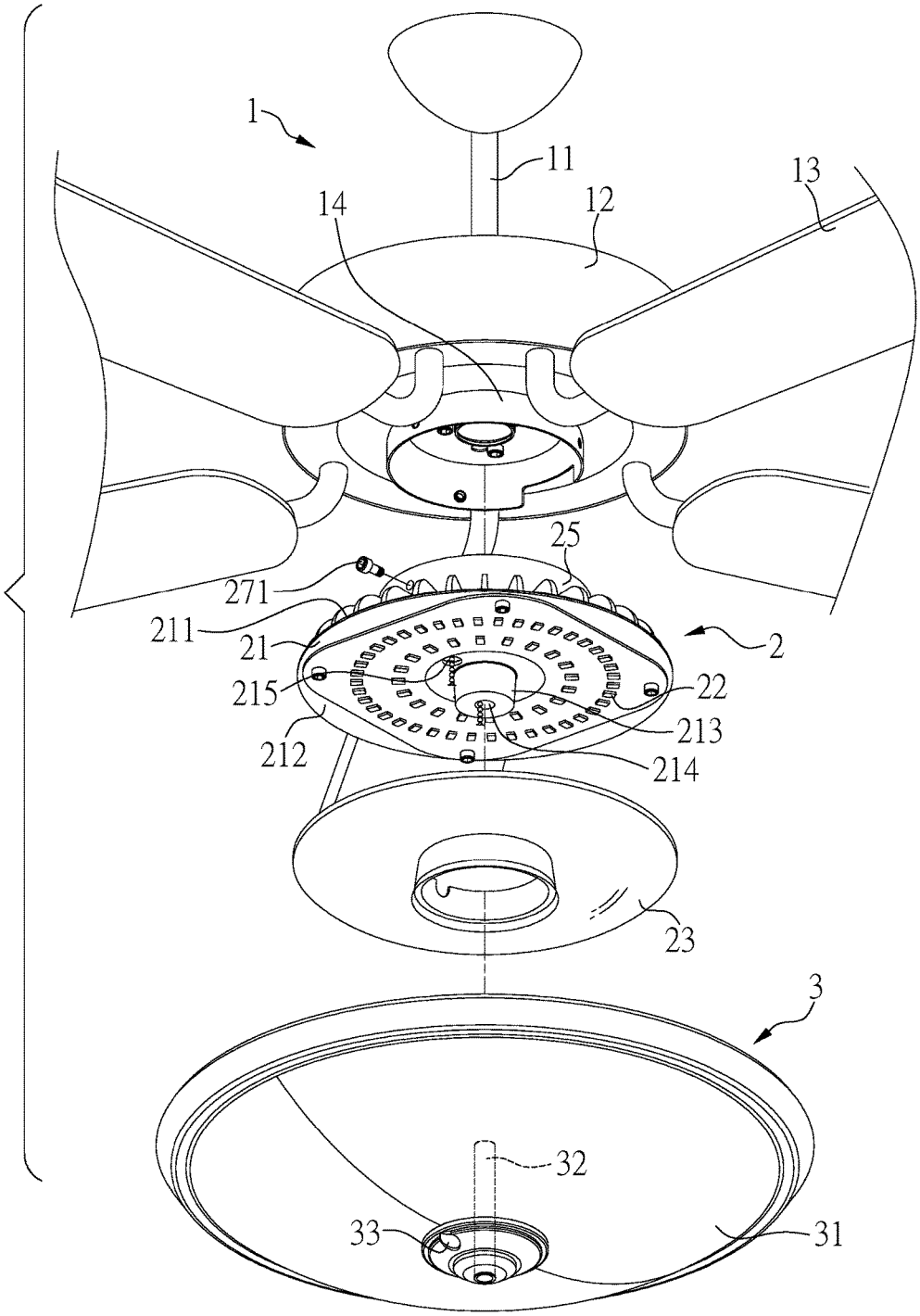
FIG. 1 is an exploded view of a lighting structure for a ceiling fan according to the present invention.

Referring to FIG. 1, the present invention provides a lighting structure 2 for a ceiling fan 1. The lighting structure 2 is coupled to the ceiling fan 1 to operate in conjunction with the ceiling fan 1. The ceiling fan 1 essentially comprises a support 11, a driving device 12, a rotatable bladed fan 13 and a holder 14. The support 11 hangs from the ceiling. The driving device 12 (exemplified by a motor in this embodiment) is disposed on the support 11. The rotatable bladed fan 13 is connected to the driving device 12 so that the driving device 12 drives the bladed fan 13 to rotate. The holder 14 is disposed at the bottom end of the support 11 and connected to the lighting structure 2.

Figure 2:
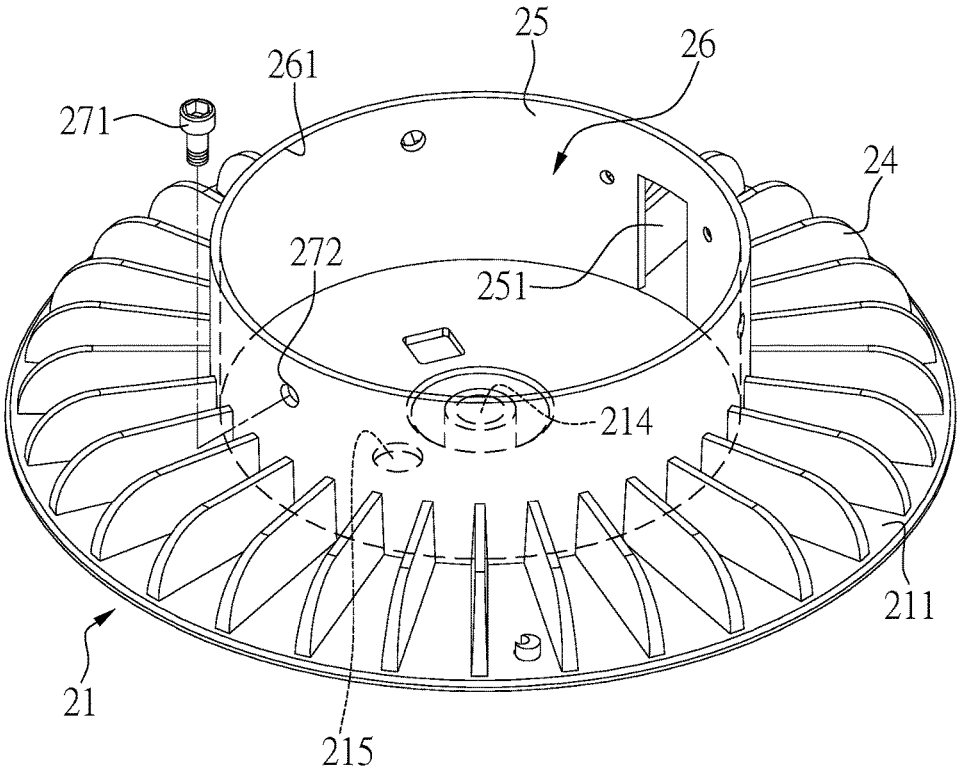
FIG. 2 is an exploded view of a substrate of the lighting structure from another angle according to the present invention.

Referring to FIGS. 1, 2, the lighting structure 2 comprises a substrate 21 which has a top surface 211 and a bottom surface 212. A circuit (not shown) and at least a lamp 22 are disposed on the bottom surface 212. In this embodiment, the at least a lamp 22 is an LED lamp driven by the circuit. Considering that the at least a lamp 22 in operation generates heat and thus raises ambient temperature, it is necessary to prevent users from touching the at least a lamp 22 inadvertently. To this end, a protective cover 23 is disposed on the bottom surface 212 of the substrate 21 to cover the at least a lamp 22 and effectuate insulation Referring to FIG. 2, a plurality of fins 24 and an upright wall 25 are disposed on the top surface 211 of the substrate 21. In this embodiment, the upright wall 25 not only extends upward but also extends to turn about the center of the top surface 211 and thus around an enclosure to form a receiving chamber 26 within the enclosure. The top end of the upright wall 25 defines an opening 261 of the receiving chamber 26. A first connection portion is disposed near the top end of the upright wall 25 and connected to the holder 14 of the ceiling fan 1. In this embodiment, the first connection portion is provided in the form of a combination of a screw 271 and a screw hole 272. The screw 271 penetrates the screw hole 272 to get fastened to the holder 14 of the ceiling fan 1.

The fins 24, which are each sheet-shaped and are collectively radiating, are disposed on the top surface 211 and outside the upright wall 25. Each fin 24 has one end connected to the upright wall 25 and the other end extended to the edge of the top surface 211.

Figure 3:
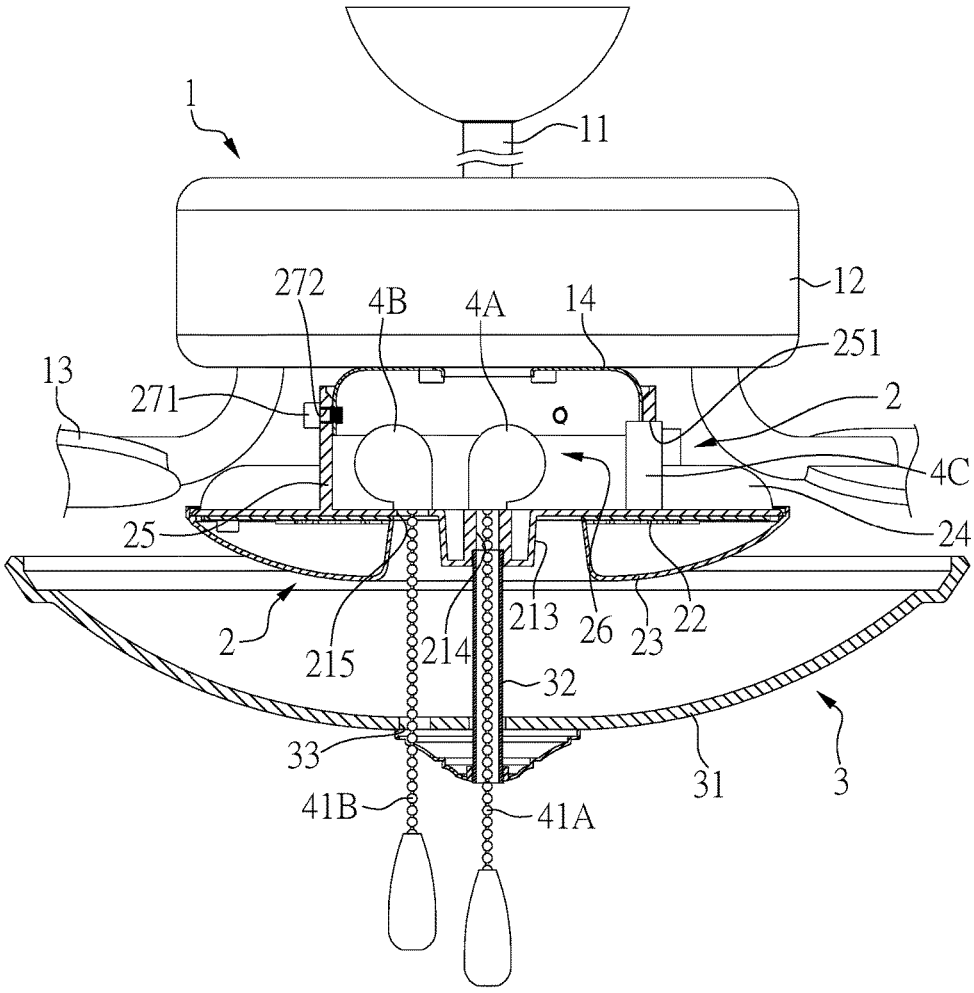
FIG. 3 is a cross-sectional view of the lighting structure mounted on a novel ceiling fan according to the present invention.

A second connection portion 213 is centrally disposed on the bottom surface 212 and connected to a decorative cover 3. Referring to FIGS. 1, 3, a first through hole 214 is penetratingly disposed at the second connection portion 213 in a manner to get exposed from the bottom surface 212 and in communication with the receiving chamber 26. The decorative cover 3 comprises a lid 31. A middle post 32, which is pipe-shaped and has a hollow core, is centrally disposed on the lid 31. The middle post 32 and the first through hole 214 are threaded to thereby mesh with each other so that the decorative cover 3 is fixedly connected to the substrate 21 from below.

A second through hole 215 is disposed in the receiving chamber 26 to penetrate the substrate 21. A third through hole 33 corresponding in position to the second through hole 215 is disposed on the decorative cover 3. The upright wall 25 has a window 251.

Referring to FIG. 3, given the aforesaid structures, the present invention is characterized in that: the at least a lamp 22 emits light for use by a lighting; the receiving chamber 26 enclosed and formed by the upright wall 25 receives various electronic components and wires (not shown) which control the ceiling fan 1 and the lighting structure 2; and the upright wall 25 gets coupled to the holder 14 of the ceiling fan 1 so as to block the opening 261 of the receiving chamber 26, thereby ensuring that the electronic components and wires are well received. The electronic components received in the receiving chamber 26 include two zipper switches 4A, 4B for controlling the ceiling fan 1 and the at least a lamp 22, respectively. The zipper switch 4A for controlling the ceiling fan 1 has a control zipper 41A which passes through the first through hole 214 and the middle post 32 to protrude downward and thus hang freely so that users can pull the control zipper 41A easily in order to control the ceiling fan 1. The zipper switch 4B for controlling the at least a lamp 22 has a control zipper 41B which passes through the second through hole 215 and the third through hole 33 to protrude downward and thus hang freely so that users can pull the control zipper 41B easily in order to control the lighting structure 2. A toggle switch 4C is disposed in the receiving chamber 26 and adapted to control the ceiling fan 1 or the at least a lamp 22. The toggle switch 4C protrudes from the window 251 so as to be manipulated by users.

Figure 4:
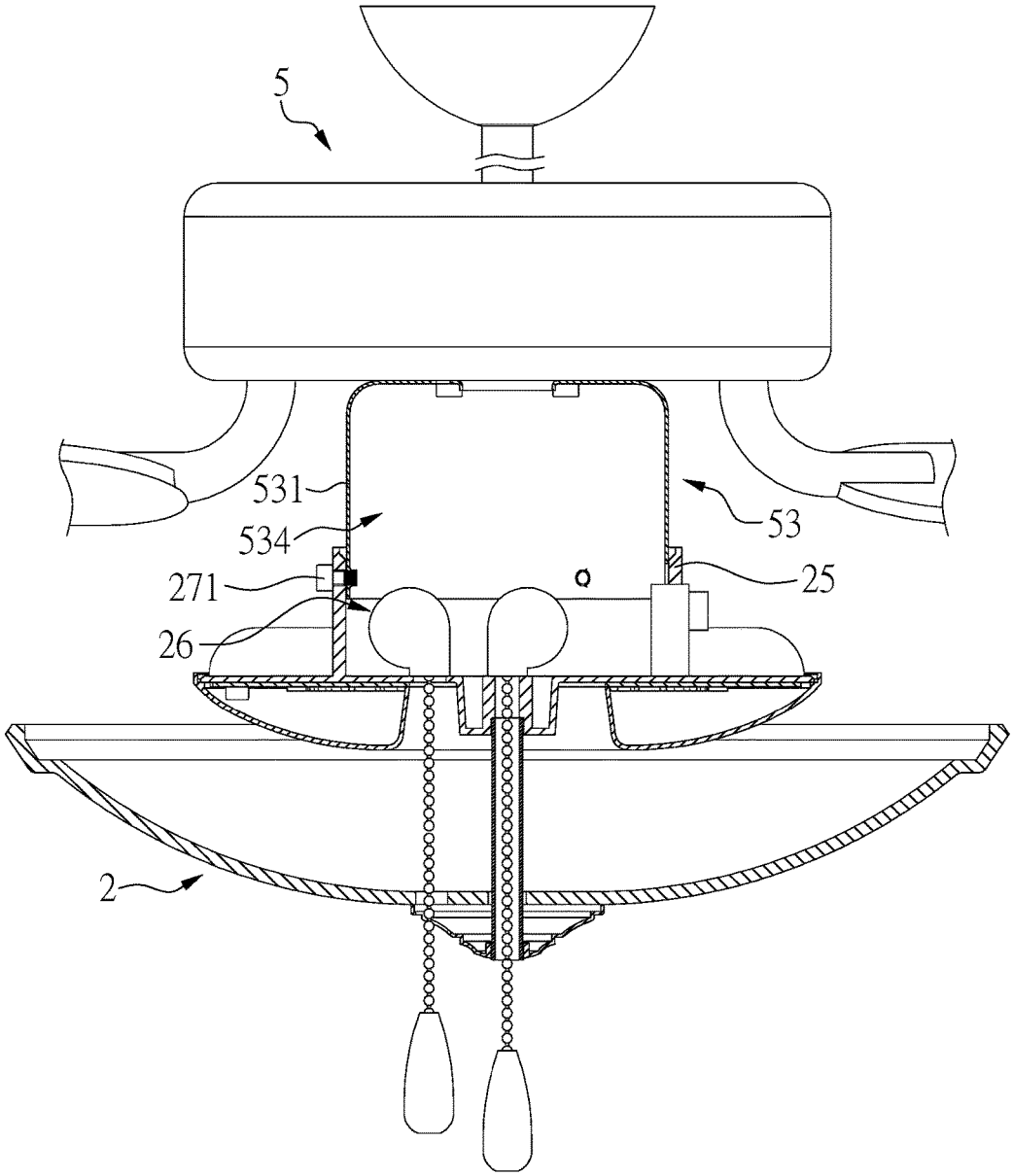
FIG. 4 is a cross-sectional view of the lighting structure mounted on a conventional ceiling fan according to the present invention.
Figure 5:
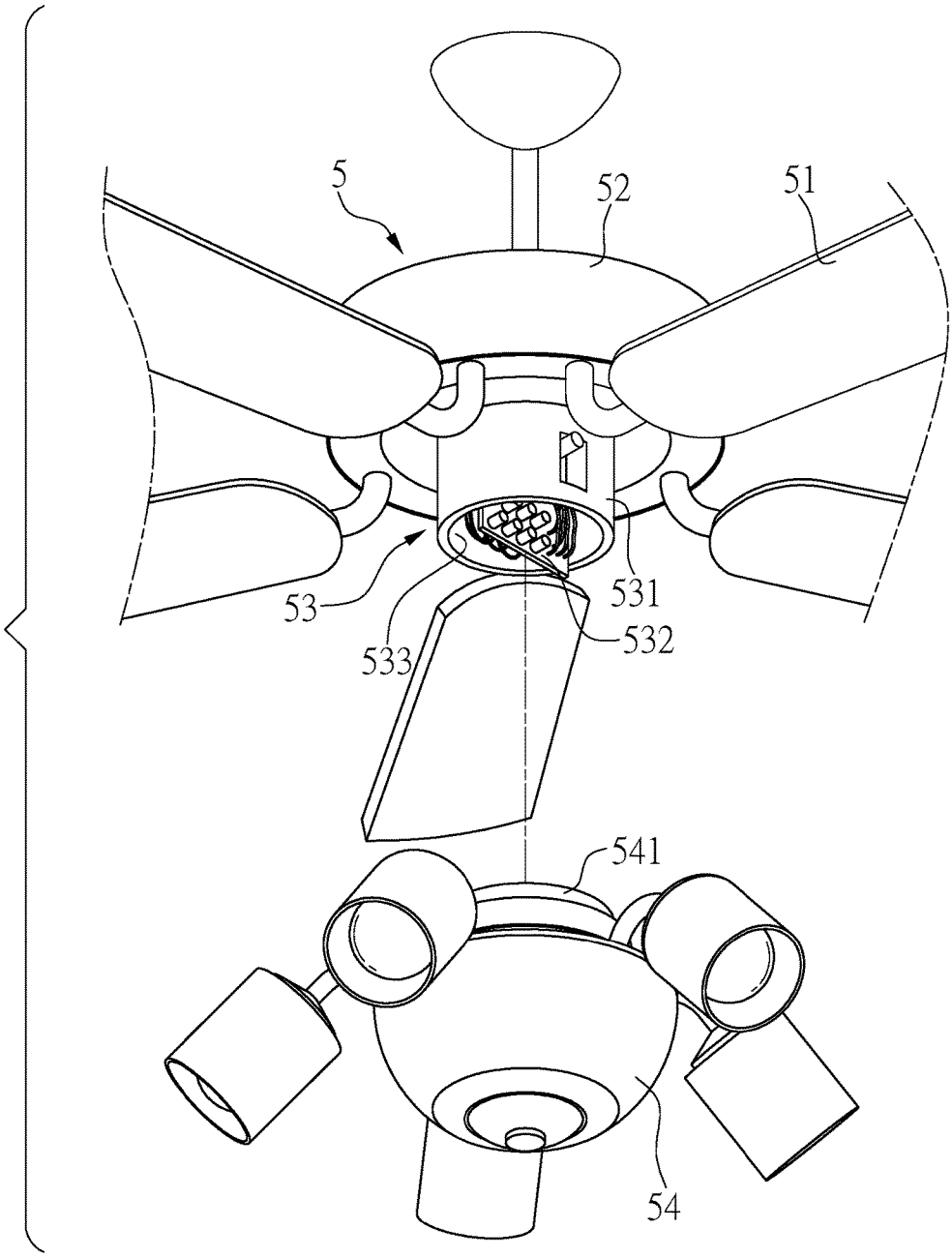
FIG. 5 PRIOR ART
FIG. 5 is a perspective view of a conventional structure.

It is also feasible that the lighting structure of the present invention is coupled to the conventional ceiling fan 5 shown in FIG. 5. Referring to FIG. 4, regarding the lighting structure 2 of the present invention, the upright wall 25 is fixedly connected to the bottom of the box 531 of the control device 53 of the ceiling fan 5 by the screw 271, and in consequence the lighting structure 2 can be coupled to the ceiling fan 5. Therefore, the lighting structure 2 of the present invention is applicable to various novel and conventional ceiling fans and thus highly universal. The receiving chamber 26 enclosed and thus formed by the upright wall 25 and a space 534 of the box 531 of the control device 53 of the ceiling fan 5 are in communication with each other to constitute a cumulative effect and thereby provide a large resultant receiving space for receiving electronic components and wires advantageously.

What is claimed is:

1. A lighting structure for a ceiling fan, comprising:

a substrate having a top surface and a bottom surface;

at least a lamp disposed on the bottom surface of the substrate;

a plurality of fins disposed on the top surface of the substrate; and an upright wall directly connected with the top surface of the substrate and extending upward, wherein the upright wall extends around an enclosure to form a receiving chamber within the enclosure, wherein a first connection portion is disposed near a top end of the upright wall and connected to the ceiling fan.

2. The lighting structure for a ceiling fan according to claim 1, wherein the upright wall extends to form a circle, the fins are disposed outside the upright wall.

3. The lighting structure for a ceiling fan according to claim 1, wherein a protective cover for covering the at least a lamp is disposed on the bottom surface of the substrate.

4. The lighting structure for a ceiling fan according to claim 1, wherein a second connection portion is disposed on the bottom surface of the substrate, whereas a decorative cover comprising a lid and a middle post is disposed below the substrate and disposed on the second connection portion through the middle post.

5. The lighting structure for a ceiling fan according to claim 4, wherein the middle post is pipe-shaped and has a hollow core, and a first through hole is penetratingly disposed at the second connection portion in a manner to get exposed from the bottom surface, in communication with the receiving chamber, and in communication with the middle post.

6. The lighting structure for a ceiling fan according to claim 5, wherein a zipper switch for controlling the ceiling fan is disposed in the receiving chamber and equipped with a control zipper, and the control zipper passes through the first through hole and the middle post to protrude from the receiving chamber.

7. The lighting structure for a ceiling fan according to claim 1, wherein a second through hole is disposed in the receiving chamber to penetrate the substrate.

8. The lighting structure for a ceiling fan according to claim 7, wherein a zipper switch for controlling the at least a lamp is disposed in the receiving chamber, and the zipper switch has a control zipper which passes through the second through hole to protrude from the receiving chamber.

9. The lighting structure for a ceiling fan according to claim 1, wherein the ceiling fan comprises a support, a rotatable bladed fan, a driving device and a holder, with the driving device disposed on the support and connected to the bladed fan so as to drive the bladed fan to rotate, and with the holder disposed on the support and connected to the first connection portion of the upright wall.

* * * * *